US012169073B2

(12) United States Patent
Yi et al.

(10) Patent No.: US 12,169,073 B2
(45) Date of Patent: Dec. 17, 2024

(54) BREEZELESS STRUCTURE FOR AIR CONDITIONER AND AIR CONDITIONER HAVING THE SAME

(71) Applicants: GD MIDEA AIR-CONDITIONING EQUIPMENT CO., LTD., Guangdong (CN); MIDEA GROUP CO., LTD., Guangdong (CN)

(72) Inventors: Zhengqing Yi, Guangdong (CN); Ansheng Ji, Guangdong (CN); Peng Xie, Guangdong (CN); Qiwei Liu, Guangdong (CN); Fuxing Zhai, Guangdong (CN); Shaosheng Guo, Guangdong (CN); Jian He, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 171 days.

(21) Appl. No.: 17/740,803

(22) Filed: May 10, 2022

(65) Prior Publication Data

US 2022/0268452 A1 Aug. 25, 2022

Related U.S. Application Data

(63) Continuation of application No. PCT/CN2020/127808, filed on Nov. 10, 2020.

(30) Foreign Application Priority Data

Nov. 13, 2019 (CN) ..... 201911108261.4
Nov. 13, 2019 (CN) ..... 201921961268.6

(51) Int. Cl.
*F24F 1/0011* (2019.01)
*F24F 1/0033* (2019.01)
(Continued)

(52) U.S. Cl.
CPC ..... *F24F 1/0011* (2013.01); *F24F 1/0033* (2013.01); *F24F 13/082* (2013.01); *F24F 13/20* (2013.01); *F24F 2013/205* (2013.01)

(58) Field of Classification Search
CPC ..... F24F 1/0011; F24F 1/0033; F24F 13/082; F24F 13/20; F24F 2013/205
See application file for complete search history.

(56) References Cited

U.S. PATENT DOCUMENTS

2008/0038111 A1* 2/2008 Iwasaki ..... F04D 25/166 415/198.1
2018/0259201 A1* 9/2018 Sato ..... F04D 29/54

FOREIGN PATENT DOCUMENTS

CN 105509284 A * 4/2016
CN 105509285 A 4/2016
(Continued)

OTHER PUBLICATIONS

Zhang et al., Air Deflector Assembly for Air Conditioner, Apr. 20, 2016, CN105509284A, Whole Document (Year: 2016).*
(Continued)

*Primary Examiner* — Larry L Furdge
(74) *Attorney, Agent, or Firm* — Scully, Scott, Murphy & Presser, P.C.

(57) ABSTRACT

A breezeless structure and an air conditioner are provided. The breezeless structure has an air dispersing structure, which has a stationary blade assembly and a rotating member spaced apart from each other in an air-flowing direction. The rotating member is rotatable relative to the stationary blade assembly. The stationary blade assembly has a plurality of stationary blades spaced apart from each other in a circumferential direction of the stationary blade assembly. The rotating member has a plurality of rotating blades spaced apart from each other in a circumferential direction of the rotating member. Each rotating blade is obliquely
(Continued)

disposed to allow air to flow on opposite side walls of the rotating blade. Alternatively or additionally, each stationary blade is obliquely disposed to allow air to flow on opposite side walls of the stationary blade.

18 Claims, 9 Drawing Sheets

(51) Int. Cl.
*F24F 13/08* (2006.01)
*F24F 13/20* (2006.01)

(56) References Cited

FOREIGN PATENT DOCUMENTS

| | | | | |
|---|---|---|---|---|
| CN | 205351503 | U | | 6/2016 |
| CN | 107588528 | A | | 1/2018 |
| CN | 107655188 | A | | 2/2018 |
| CN | 107702216 | A | * | 2/2018 |
| CN | 207073927 | U | | 3/2018 |
| CN | 207146602 | U | | 3/2018 |
| CN | 207555772 | U | * | 6/2018 |
| CN | 110319565 | A | | 10/2019 |
| CN | 110319569 | A | | 10/2019 |
| CN | 110701771 | A | | 1/2020 |
| CN | 110701772 | A | | 1/2020 |
| CN | 210861621 | U | | 6/2020 |
| CN | 210861622 | U | | 6/2020 |
| JP | 2003184797 | A | | 7/2003 |
| JP | 2011080617 | A | | 4/2011 |

OTHER PUBLICATIONS

Zhou et al., Wall-mounted Indoor Unit and Air Conditioner, Feb. 16, 2018, CN 107702216A, Whole Document (Year: 2018).*

Tian et al., Wall-mounted air Conditioner Indoor Unit and Air Conditioner . . . , Jun. 29, 2018, CN207555772U, Whole Document (Year: 2018).*

International Search Report dated Feb. 19, 2021 received in International Application No. PCT/CN2020/127808.

Extended European Search Report dated Nov. 24, 2022 received in European Patent Application No. EP 20887213.5.

Written Opinion of the International Searching Authority dated Feb. 19, 2021 received in International Application No. PCT/CN2020/127808.

First Office Action dated Apr. 28, 2024 received in Chinese Patent Application No. CN 201911108261.4.

* cited by examiner

BREEZELESS STRUCTURE FOR AIR CONDITIONER AND AIR CONDITIONER HAVING THE SAME

CROSS-REFERENCE TO RELATED APPLICATIONS

The present application is a continuation application of PCT International Patent Application No. PCT/CN2020/127808, filed on Nov. 10, 2020, which claims priority to and benefits of Chinese Patent Application No. 201911108261.4 and Chinese Patent Application No. 201921961268.6, both filed on Nov. 13, 2019, the entire contents of which are incorporated herein by reference for all purposes. No new matter has been introduced.

FIELD

The present disclosure relates to the field of air conditioners, and more particularly, to a breezeless structure for an air conditioner and an air conditioner having the breezeless structure.

BACKGROUND

In the related art, air blown from the air conditioner contacts only one side of a blade, which causes an uneven heating of the blade. Thus, a condensation phenomenon may occur on the side of the blade having the lower temperature, thereby reducing the comfortableness of using the air conditioner.

SUMMARY

The present disclosure is directed to solving at least one of problems in the related art.

Therefore, an object of the present disclosure is to provide a breezeless structure for an air conditioner, which can avoid a problem of condensation formed on a rotating blade or a stationary blade when the air conditioner is blowing air.

Another object of the present disclosure is to provide an air conditioner having the above breezeless structure.

According to the breezeless structure of air conditioner of embodiments of the present disclosure, the air conditioner includes a housing having a first air outlet, the breezeless structure is movably disposed on the housing to at least partially cover the first air outlet or avoid the first air outlet, the breezeless structure includes an air dispersing structure, in which the air dispersing structure includes a stationary blade assembly and a rotating member that are spaced apart from each other in an air-flowing direction; the rotating member is rotatable relative to the stationary blade assembly; the stationary blade assembly includes a plurality of stationary blades spaced apart from each other in a circumferential direction; the rotating member includes a plurality of rotating blades spaced apart from each other in the circumferential direction; and each of the plurality of rotating blades is obliquely disposed to allow air to flow on opposite side walls of the rotating blade, and/or each of the plurality of stationary blades is obliquely disposed to allow air to flow on opposite side walls of the stationary blade.

According to the breezeless structure of the air conditioner, air blown from the air conditioner is firstly dispersed through the air dispersing structure to achieve a breezeless effect of the air conditioner and improve a comfortableness of the air conditioner. Meanwhile, each of the plurality of rotating blades is obliquely disposed to allow air to flow on opposite side walls of the rotating blade, and/or each of the plurality of stationary blades is obliquely disposed to allow air to flow on opposite side walls of the stationary blade, and then the opposite side walls of each stationary blade and/or the opposite side walls of each rotating blade are uniformly heated. Therefore, the condensation phenomenon is avoided, and the quality and the comfortableness of the air conditioner are improved.

In some embodiments of the present disclosure, each of the plurality of rotating blades and each of the plurality of stationary blades are obliquely disposed along a same oblique direction.

In some embodiments of the present disclosure, the breezeless structure further includes a first driving member connected to the rotating member to drive the rotating member to rotate.

In some embodiments of the present disclosure, a plurality of rotating members are provided, every two adjacent rotating members of the plurality of rotating members have a transmission gear disposed therebetween and are each engaged with the transmission gear, allowing the plurality of rotating members to rotate synchronously.

In some embodiments of the present disclosure, a plurality of stationary blade assemblies are provided in one-to-one correspondence with the plurality of rotating members.

In some embodiments of the present disclosure, the breezeless structure of the air conditioner further includes a movable panel movably disposed on the housing, in which the movable panel has a plurality of air dispersing holes disposed thereon, and the air dispersing structure is disposed on a side wall surface of the movable panel facing towards the first air outlet and is directly opposite to at least a portion of the plurality of air dispersing holes.

In some embodiments of the present disclosure, the air dispersing structure includes a mounting plate disposed on the movable panel, the mounting plate has a ventilation hole disposed thereon, the rotating member is rotatably connected to the mounting plate and directly opposite to the ventilation hole, and the stationary blade assembly is disposed in the ventilation hole.

In some embodiments of the present disclosure, the movable panel includes a front side plate, and a bottom plate connected to a lower end of the front side plate; the plurality of air dispersing holes is disposed on the front side plate; when the first air outlet is covered by the movable panel, the front side plate is directly opposite to the first air outlet, the bottom plate is disposed below the first air outlet, and the air dispersing structure is disposed on the front side plate.

In some embodiments of the present disclosure, the breezeless structure further includes a limiting plate disposed on the movable panel, in which the limiting plate is adapted to, during a movement of the movable panel, be in contact with the housing to limit a displacement of the movable panel.

An air conditioner according to an embodiment of the present disclosure includes a housing having a first air outlet; and the breezeless structure according to the above embodiments of the present disclosure, in which the breezeless structure is movably disposed on the housing to at least partially cover the first air outlet or avoid the first air outlet, and the breezeless structure is adapted to disperse air blown from the first air outlet.

For the air conditioner provided by embodiments of the present disclosure, the air blown from the air conditioner is firstly dispersed through the air diffusing structure, so as to provide a breezeless of the air conditioner, thereby improving the comfortableness of the air conditioner. Meanwhile, each of the plurality of rotating blades and/or each of the plurality of stationary blades are obliquely disposed to allow air to flow on opposite side walls of the rotating blade, and thus the opposite side walls of each stationary blade and/or the opposite side walls of each rotating blade are uniformly heated, thereby avoiding the condensation phenomenon and improving the quality and the comfortableness of the air conditioner.

Additional aspects and advantages of embodiments of the present disclosure will be provided in part in the following descriptions, or they will become apparent in part from the following descriptions, or they will be learned from the practice of the embodiments of the present disclosure.

BRIEF DESCRIPTION OF DRAWINGS

The above-mentioned and other aspects and advantages of embodiments of the present disclosure will become apparent and more readily appreciated from the following descriptions with reference to the accompanying drawings.

REFERENCE NUMERALS SHOWN IN THE FIGURES ARE DESCRIBED AS FOLLOWS

Figure 1:
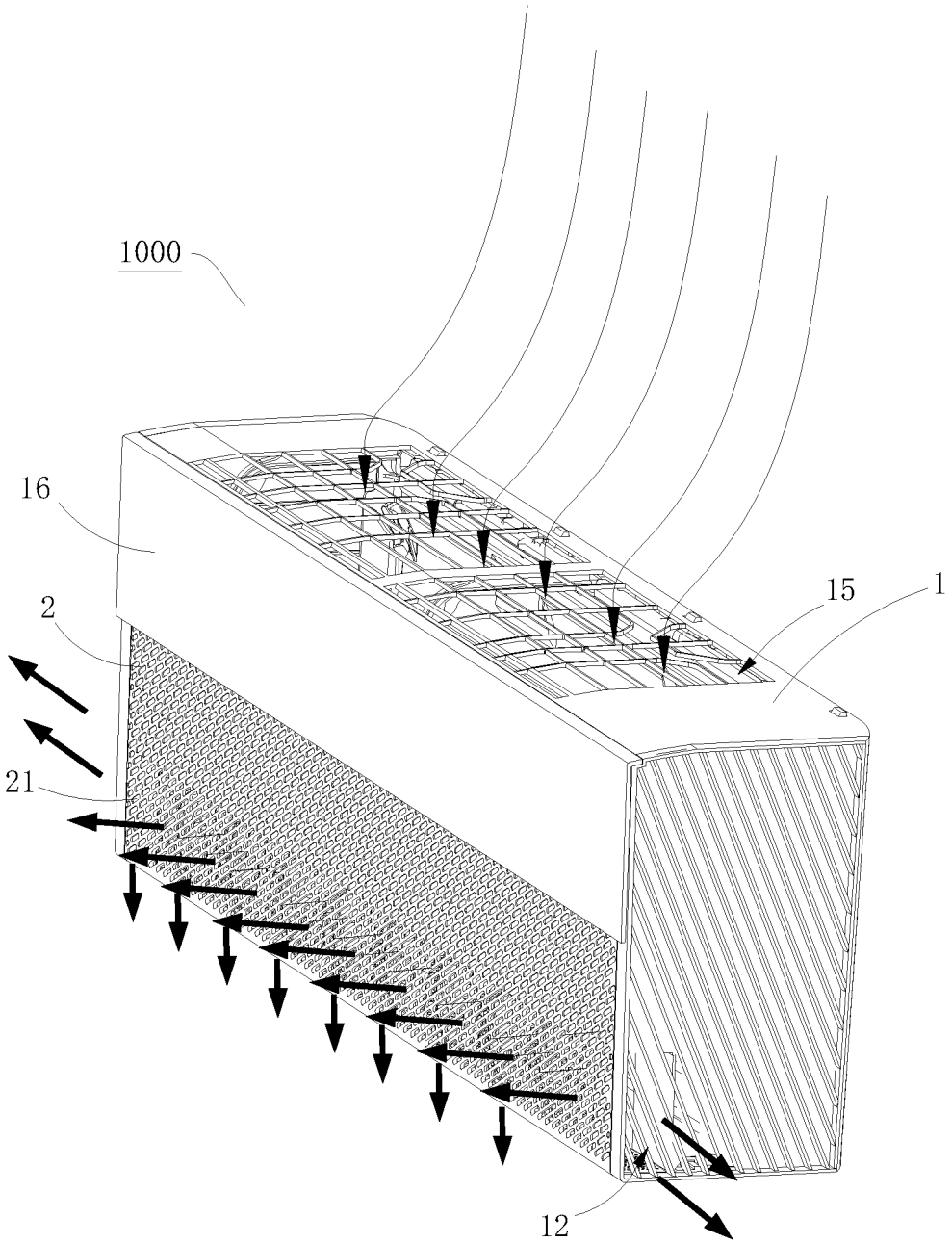
FIG. 1 is a schematic perspective view of an air conditioner according to an embodiment of the present disclosure.

1000 air conditioner;

100 breezeless structure;

1 housing; 11 first air outlet; 12 second air outlet; 121 louver; 13 receiving cavity; 14 flow guide plate; 15 air inlet; 16 upper panel;

2 movable panel; 21 air dispersing hole; 22 front side plate; 23 bottom plate;

3 air dispersing structure; 31 rotating member; 311 rotating blade; 3111 first inner surface;

3112 first outer surface; 32 stationary blade assembly; 321 stationary blade; 3211 second inner surface; 3212 second outer surface; 33 mounting plate; 331 ventilation hole; 34 limiting plate; 341 through hole;

4 first driving member; 41 transmission gear; 42 first gear; 43 second gear;

5 second driving mechanism; 51 motor; 52 gear; and 53 rack.

DESCRIPTION OF EMBODIMENTS

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and merely used to explain the present disclosure, rather than being construed as limitation on the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc., is based on the orientation or position relationship shown in the drawings, and is only for the convenience of describing the present disclosure and simplifying the description, rather than indicating or implying that the defined device or element must have a specific orientation or must be constructed and operated in a specific orientation. Thus, the orientation or position relationship indicated by these terms cannot be understood as limitations of the present disclosure. In addition, the terms "first" and "second" are only used for purpose of description, and cannot be understood as indicating or implying relative importance or implicitly indicating the number of indicated technical features. Therefore, the features defined with "first" and "second" may explicitly or implicitly include at least one of the features. In the description of the present disclosure, "plurality" means at least two, unless otherwise specifically defined.

In the description of the present disclosure, it should be noted that, unless otherwise clearly specified and limited, terms such as "install", "mount", "connect to" and the like should be understood in a broad sense. For example, it may be a fixed connection or a detachable connection or connection as one piece; mechanical connection or electrical connection; direct connection or indirect connection through an intermediate; internal communication of two components or the interaction relationship between two components, unless otherwise clearly limited. For those of ordinary skill in the art, the specific meaning of the above-mentioned terms in the present disclosure can be understood according to specific circumstances.

A breezeless structure 100 of an air conditioner 1000 according to an embodiment of the present disclosure is described with reference to FIG. 1 to FIG. 11. The air conditioner 1000 includes a housing 1, the housing 1 has an air inlet 15 disposed at an upper end thereof, and external air enters the air conditioner 1000 through the air inlet 15. The housing 1 has a first air outlet 11, the first air outlet 11 may be located at a lower end of the housing 1, and the air conditioner 1000 blows air through the first air outlet 11.

According to this embodiment of the present disclosure, the breezeless structure 100 of the air conditioner 1000 is movably disposed on the housing 1 to at least partially cover the first air outlet 11 or avoid the first air outlet 11. It can be understood that, through the movement of the breezeless structure 100, the first air outlet 11 can be entirely opened or closed, or a part of the first air outlet 11 can be covered and the covered part of the first air outlet 11 may be a part of the first air outlet 11 blowing air towards the user or directly blowing air to the user. In this way, the air blown from the first air outlet 11 passes through the breezeless structure 100 before blowing towards the user, so as to disperse the air blowing towards the user, thereby achieving the breezeless or air-still effect, and improving the comfortableness of the air conditioner 1000.

The breezeless structure 100 includes an air dispersing structure 3. The air dispersing structure 3 includes a stationary blade assembly 32 and a rotating member 31 that are spaced apart from each other in an air-flowing direction. The rotating member 31 is rotatable relative to the stationary blade assembly 32. It can be understood that, in a state that at least part of the first air outlet 11 is shielded by the breezeless structure 100, as the stationary blade assembly 32 and the rotating member 31 are spaced apart from each other in the air-flowing direction, the air blown from the air conditioner 1000 can be dispersed by a plurality of stationary blades 321 for one time and dispersed by the rotating member 31 in rotation for one time. Thus, the air blown from the air conditioner 1000 can be dispersed for multiple times and thus can be softened, so as to improve the comfortableness of the air conditioner 1000.

The stationary blade assembly 32 includes a plurality of stationary blades 321 spaced apart from each other in a circumferential direction of the stationary blade assembly 32. The rotating member 31 includes a plurality of rotating blades 311 spaced apart from each other in a circumferential direction of the rotating member 31. It can be understood that since the rotating member 31 is rotatable relative to the stationary blade assembly 32, the positions between the plurality of rotating blades 311 of the rotating member 31 and the plurality of stationary blades 321 can be adjusted, so as to change an opening degree of a flow channel formed between the rotating member 31 and the stationary blade assembly 32, thereby controlling a flow rate of an airflow passing through the breezeless structure 100 and controlling the air volume of the air conditioner 1000 to satisfy user's demands.

In some embodiments of the present disclosure, the stationary blade assembly 32 may be disposed at a front side of the rotating member 31 in the air-flowing direction. In this way, the air blown from the air conditioner 1000 is firstly dispersed by the plurality of stationary blades 321, and is subsequently dispersed by the rotating member 31, and the air-flowing direction is changed by the rotation of the rotating member 31, allowing the air outlet direction of the air conditioner 1000 to be more controllable.

In some embodiments of the present disclosure, the stationary blade assembly 32 may be disposed at a rear side of the rotating member 31 in the air-flowing direction. In this way, the air blown from the air conditioner 1000 is dispersed once by the rotating member 31 and subsequently dispersed once by the plurality of stationary blades 321, so as to sufficiently disperse the air blown from the air conditioner 1000, thereby allowing the air outflow of the air conditioner 1000 to be more comfortable.

In some embodiments of the present disclosure, it may be also possible that only each rotating blade 311 is obliquely disposed to allow air to flow on opposite side walls of the rotating blade 311. In some embodiments of the present disclosure, it may be also possible that only each stationary blade 321 is obliquely disposed to allow air to flow on opposite side walls of the stationary blade 321. Alternatively, in some embodiments of the present disclosure, not only each rotating blade 311 is obliquely disposed to allow air to flow on the opposite side walls of the rotating blade 311, but also each stationary blade 321 is obliquely disposed to allow air to flow on the opposite side walls of the stationary blade 321.

When each rotating blade 311 is obliquely disposed to allow air to flow on the opposite side walls of the rotating blade 311, the air blown from the air conditioner 1000 can simultaneously flow on the opposite side walls of the rotating blade 311, so as to uniformly heat the opposite side walls of the rotating blade 311, thereby avoiding a condensation phenomenon and improving the quality and comfortableness of the air conditioner 1000.

Figure 11:
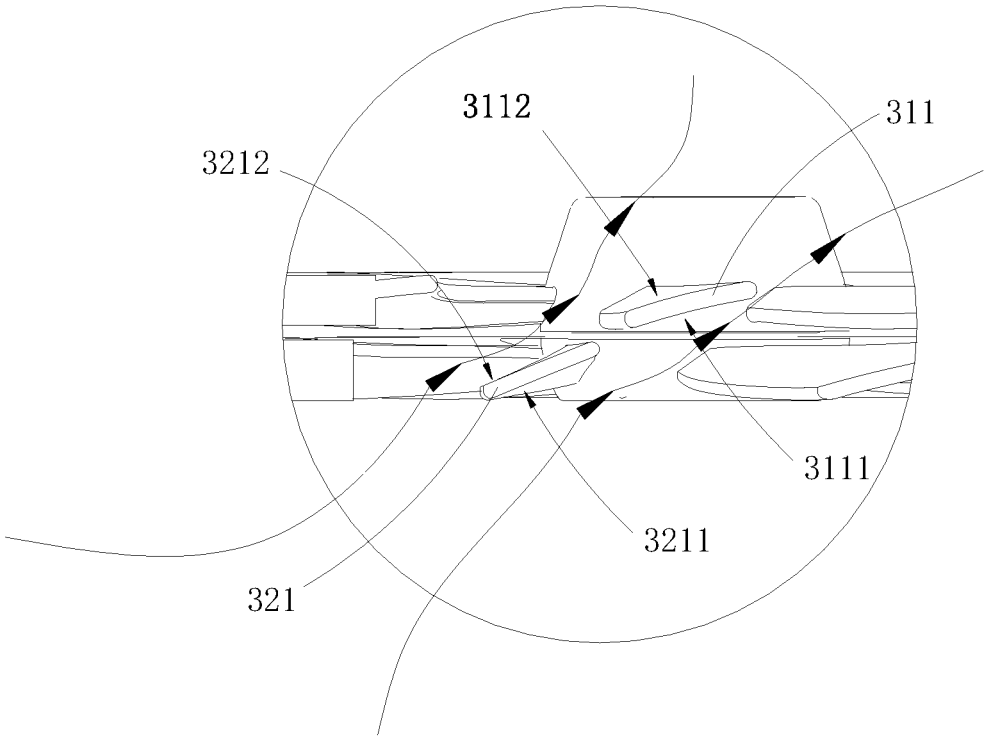
FIG. 11 is a partially enlarged view of a portion A in FIG. 10.

It should be noted that, as illustrated in FIG. 11, each rotating blade 311 has a first outer surface 3112 and a first inner surface 3111. The first outer surface 3112 and the first inner surface 3111 may be two opposite side walls of the rotating blade 311. By obliquely disposing each rotating blade 311 to change a rotation direction of the rotating blades 311, the rotating blade 311 extends substantially along the air-flowing direction, thereby avoiding obstruction to the airflow and making the airflow smoother.

Meanwhile, a portion of the air blown from the air conditioner 1000 contacts the first outer surface 3112, and a portion thereof contacts the first inner surface 3111, so as to uniformly heat the opposite side walls of the rotating blade 311, thereby avoiding the condensation phenomenon and improving the quality and comfortableness of the air conditioner 1000.

When each stationary blade 321 is obliquely disposed to allow air to flow on the opposite side walls of the stationary blade 321, the air blown from the air conditioner 1000 simultaneously passes through the opposite side walls of the stationary blade 321, so as to uniformly heat the opposite side walls of the stationary blade 321, thereby avoiding the condensation phenomenon and improving the quality and comfortableness of the air conditioner 1000.

It should be noted that, as shown in FIG. 11, each stationary blade 321 has a second outer surface 3212 and a second inner surface 3211. The second outer surface 3212 and the second inner surface 3211 may be two opposite side walls of the stationary blade 321. By obliquely disposing each stationary blade 321 to change a rotation direction of the stationary blade 321, the stationary blade 321 extends substantially along the air-flowing direction, and thus, the obstruction to the airflow is avoided and the airflow is smoother.

Meanwhile, a portion of the air blown from the air conditioner 1000 contacts the second outer surface 3212, and a portion thereof contacts the second inner surface 3211, so as to uniformly heat the opposite side walls of each stationary blade 321, thereby avoiding the condensation phenomenon and improving the quality and comfortableness of the air conditioner 1000.

In the breezeless structure 100 of the air conditioner 1000 provided by the embodiment of the present disclosure, the air blown from the air conditioner 1000 is firstly dispersed through the air dispersing structure 3 to achieve the breezeless or air-still effect of the air conditioner 1000, thereby improving the comfortableness of the air conditioner 1000. Meanwhile, each rotating blade 311 is obliquely disposed to allow air to flow on opposite side walls of the rotating blade 311; alternatively or additionally, each stationary blade 321 is obliquely disposed to allow air to flow on opposite side walls of the stationary blade 321. Thus, the opposite side walls of the stationary blade 321 and/or the opposite side walls of the rotating blade 311 can be uniformly heated, thereby avoiding the condensation phenomenon and improving the quality and comfortableness of the air conditioner 1000.

In some embodiments of the present disclosure, as shown in FIG. 11, each rotating blade 311 and each stationary blade 321 are obliquely disposed along the same oblique direction. That is, by obliquely disposing each rotating blade 311 and each stationary blade 321, the air blown from the air conditioner 1000 can contact the opposite side walls of the rotating blade 311 and the opposite side walls of the stationary blade 321, so as to uniformly heat the opposite side walls of the rotating blade 311 and the opposite side walls of the stationary blade 321. Therefore, the condensation phenomenon is prevented from occurring on the rotating member 31 and the stationary blade assembly 32, thereby improving the quality and comfortableness of the air conditioner 1000.

Meanwhile, the oblique direction of the stationary blade 321 is consistent with the oblique direction of the rotating blade 311, and thus an extending direction of the stationary blade 321 is approximately the same as an extending direction of the rotating blade 311. In this way, the airflow can continuously flow along the side walls of the rotating blade 311 after passing through the side walls of the stationary blade 321, to reduce the obstruction to the airflow. In addition, the opposite side walls of each stationary blade 321 and the opposite side walls of each rotating blade 311 can be in contact with the air, thereby further solving the problem of condensation on the rotating member 31 and the stationary blade assembly 32.

In some embodiments of the present disclosure, each rotating blade 311 and each stationary blade 321 are obliquely disposed, and the oblique direction of the stationary blade 321 may not be consistent with the oblique direction of the rotating blade 311. As long as the air blown from the air conditioner 1000 can be in contact with and thus uniformly heat the opposite side walls of the rotating blade 311 and the opposite side walls of the stationary blade 321, the condensation phenomenon can be prevented from occurring on the rotating member 31 and the stationary blade assembly 32, thereby improving the quality and comfortableness of the air conditioner 1000.

Figure 7:
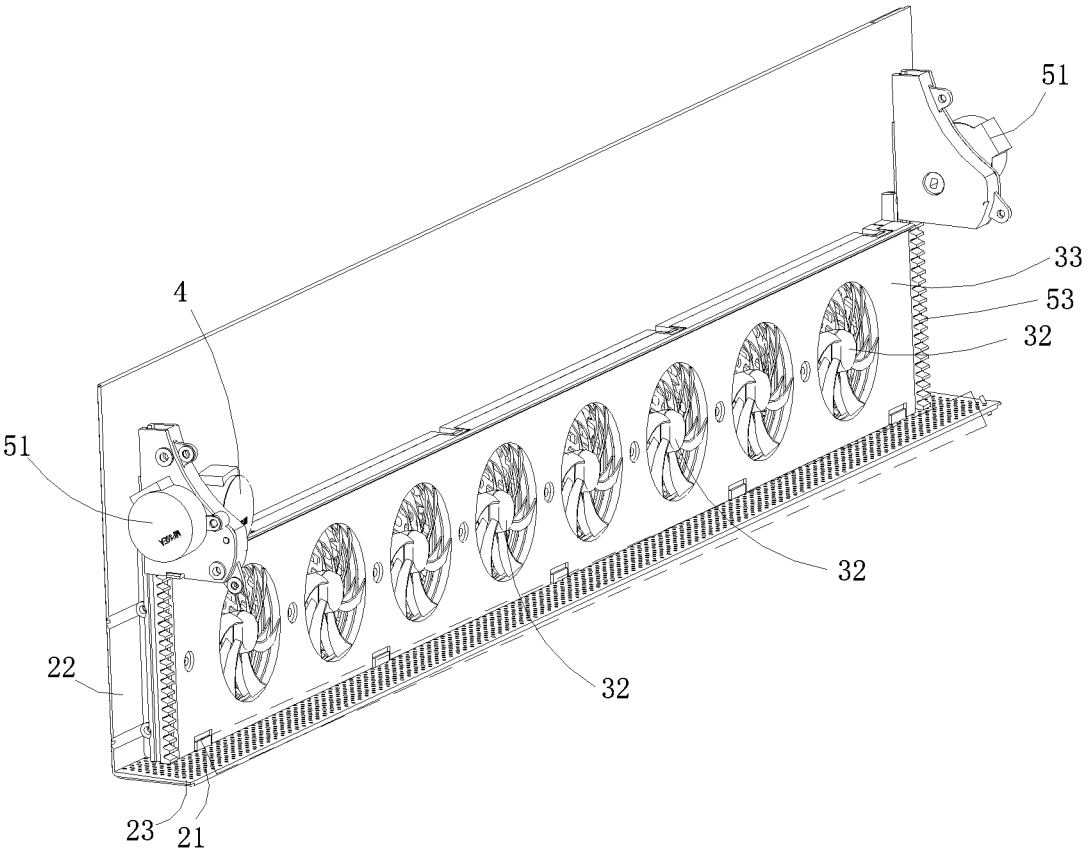
FIG. 7 is a schematic perspective view of a breezeless structure according to an embodiment of the present disclosure.
Figure 8:
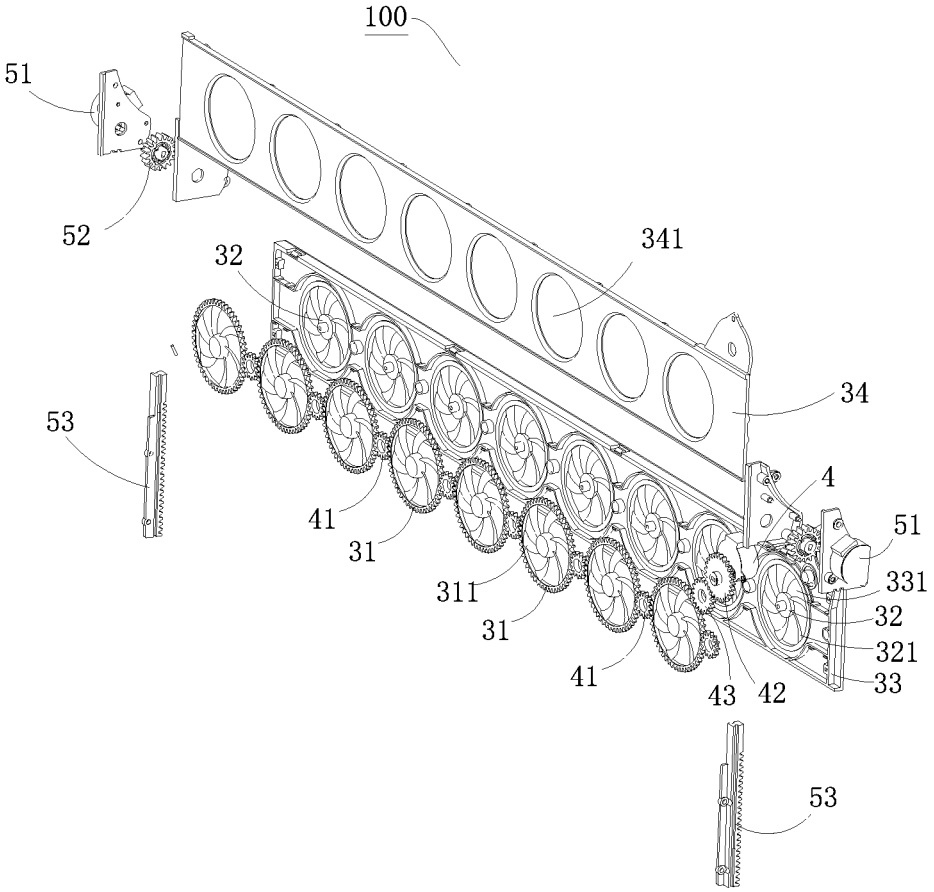
FIG. 8 is an exploded view of a breezeless structure according to an embodiment of the present disclosure.
Figure 9:
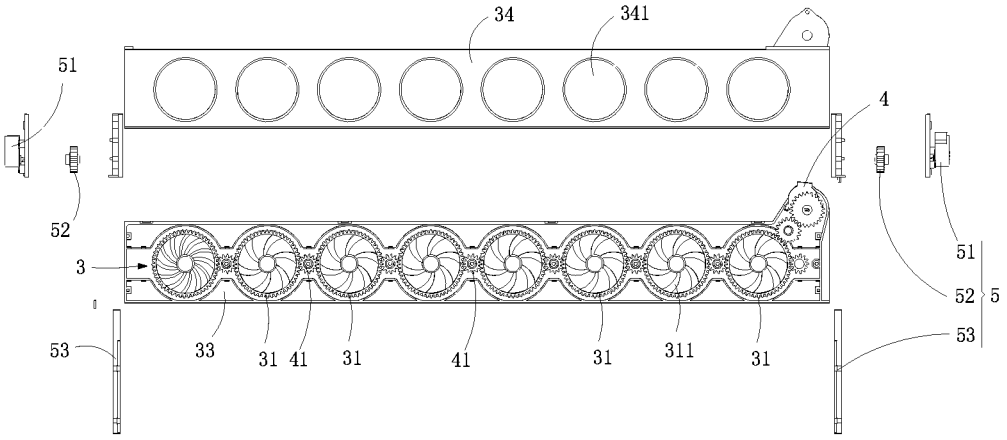
FIG. 9 is a front view of a breezeless structure according to an embodiment of the present disclosure.
Figure 10:
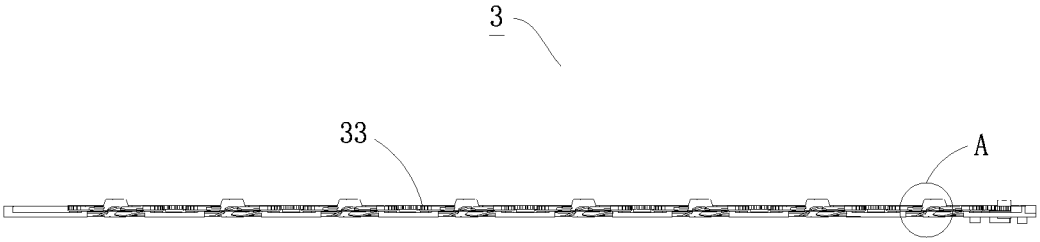
FIG. 10 is a top view of an air dispersing structure according to an embodiment of the present disclosure.

In some embodiments of the present disclosure, as shown in FIG. 7 to FIG. 9, the breezeless structure 100 further includes a first driving member 4. The first driving member 4 is connected to the rotating member 31 to drive the rotating member 31 to rotate. That is, the rotating member 31 is rotated by the first driving member 4, allowing the rotation of the rotating member 31 to be simpler and more reliable. In some embodiments of the present disclosure, the first driving member 4 can be mounted on the mounting plate 33, so that the transmission between the first driving member 4 and the rotating member 31 is more reliable, and the first driving member 4 can be located above the rotating member 31 to prevent the first driving member 4 from obstructing the airflow, so that the airflow can flow more smoothly.

In some embodiments of the present disclosure, as shown in FIG. 7 to FIG. 9, the first driving member 4 may be a driving motor, a first gear 42 is connected to an output shaft of the driving motor, a second gear 43 is disposed between the first gear 42 and the rotating member 31, and the second gear 43 is engaged with the first gear 42 and the rotating member 31. In this way, the first gear 42 can be driven by the rotating output shaft of the driving motor to rotate, and further the first gear 42 can drive the rotating member 31 to rotate through the second gear 43. At the same time, a rotation speed and a rotation precision of the rotating member 31 can be controlled by changing gear ratios of the first gear 42, the second gear 43, and the rotating member 31.

In some embodiments of the present disclosure, a plurality of rotating members 31 are provided, and every two adjacent rotating members 31 have a transmission gear 41 disposed therebetween and are each engaged with the transmission gear 41, allowing the plurality of rotating members 31 to rotate synchronously. That is, when the plurality of rotating members 31 are provided, the transmission gear 41 can be disposed between every two adjacent rotating members 31 in such a manner that the two adjacent rotating members 31 are each engaged with the transmission gear 41, allowing the plurality of rotating members 31 to rotate synchronously. In this way, it is ensured that rotation angles of the rotating members 31 are the same to maintain the same air dispersion effects of the rotating members 31, allowing the air blown from the air conditioner 1000 to be more uniform.

In some embodiments of the present disclosure, a plurality of stationary blade assemblies are provided in one-to-one correspondence with the plurality of rotating members. By providing the plurality of rotating members 31 in one-to-one correspondence with the plurality of stationary blades 321, the airflow-diffusing function of the breezeless structure 100 can be intensified, thereby improving the comfortableness of the air conditioner 1000.

In some embodiments of the present disclosure, as shown in FIG. 1 to FIG. 9, the breezeless structure 100 further includes a movable panel 2 movably disposed on the housing 1. The movable panel 2 has a plurality of air dispersing holes 21 disposed thereon. The air dispersing structure 3 is disposed on a side wall surface of the movable panel 2 facing towards the first air outlet 11 and is directly opposite to at least a portion of the plurality of air dispersing holes 21. That is, by moving the movable panel 2 on the housing 1, the movable panel 2 can at least partially cover or avoid the first air outlet 11. In a state that the first air outlet 11 is covered by the movable panel 2, the air blown from the air conditioner 1000 is first dispersed by the air dispersing structure 3, and then the dispersed air is dispersed through the plurality of air dispersing holes 21 on the movable panel 2 and flows towards an environment where the air conditioner 1000 is located, so as to achieve the breezeless or air-still effect of the air blown from the air conditioner 1000, thereby improving the comfortableness of the air conditioner 1000.

In some embodiments of the present disclosure, as shown in FIG. 3 to FIG. 6, the movable panel 2 moves in an up-and-down direction, the movable panel covers the first air outlet 11 when moving downwards, and the movable panel avoids the first air outlet 11 when moving upwards. In this way, the movement of the movable panel 2 is simpler and occupies a smaller moving space. It is understood that the movable panel 2 may be disposed on the housing 1 to move left and right.

It should be noted that, without changing an air-blowing state by the user, the movable panel 2 may be moved to make the first air outlet 11 in an open state, in which the movable panel 2 avoids the first air outlet 11, so that the air blown from the air conditioner 1000 directly blows towards the environment where the air conditioner 1000 is located through the first air outlet 11. Further, the air-blowing state of the air conditioner 1000 may be changed based on a selection of the user, allowing the air-blowing of the air conditioner 1000 to be more selectable. Thus, the air conditioner 1000 can meet different requirements of the user.

Figure 2:
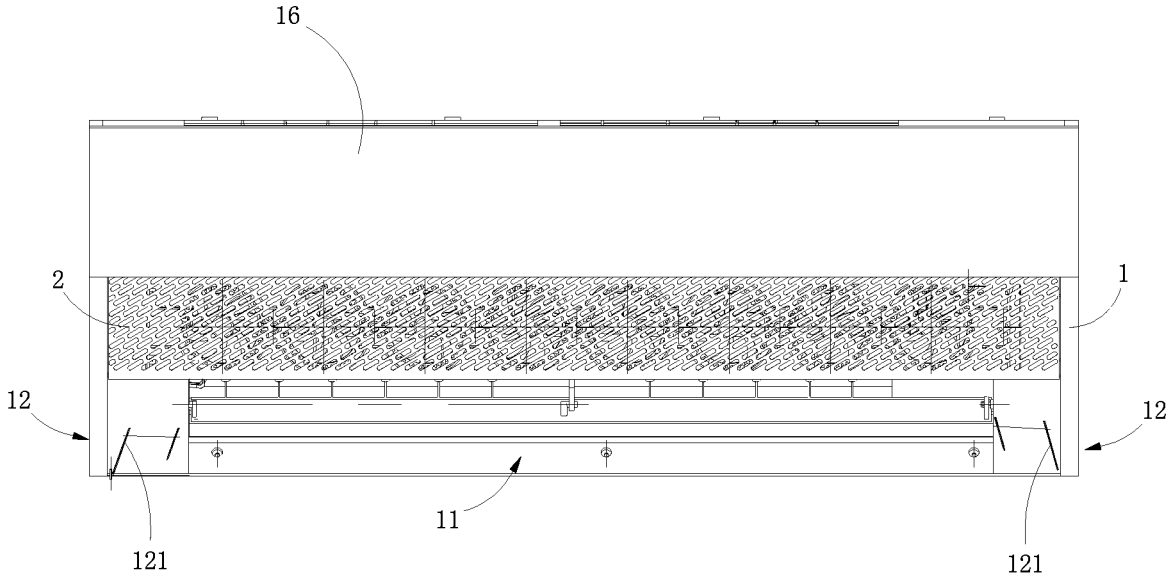
FIG. 2 is a front view of an air conditioner according to an embodiment of the present disclosure.
Figure 3:
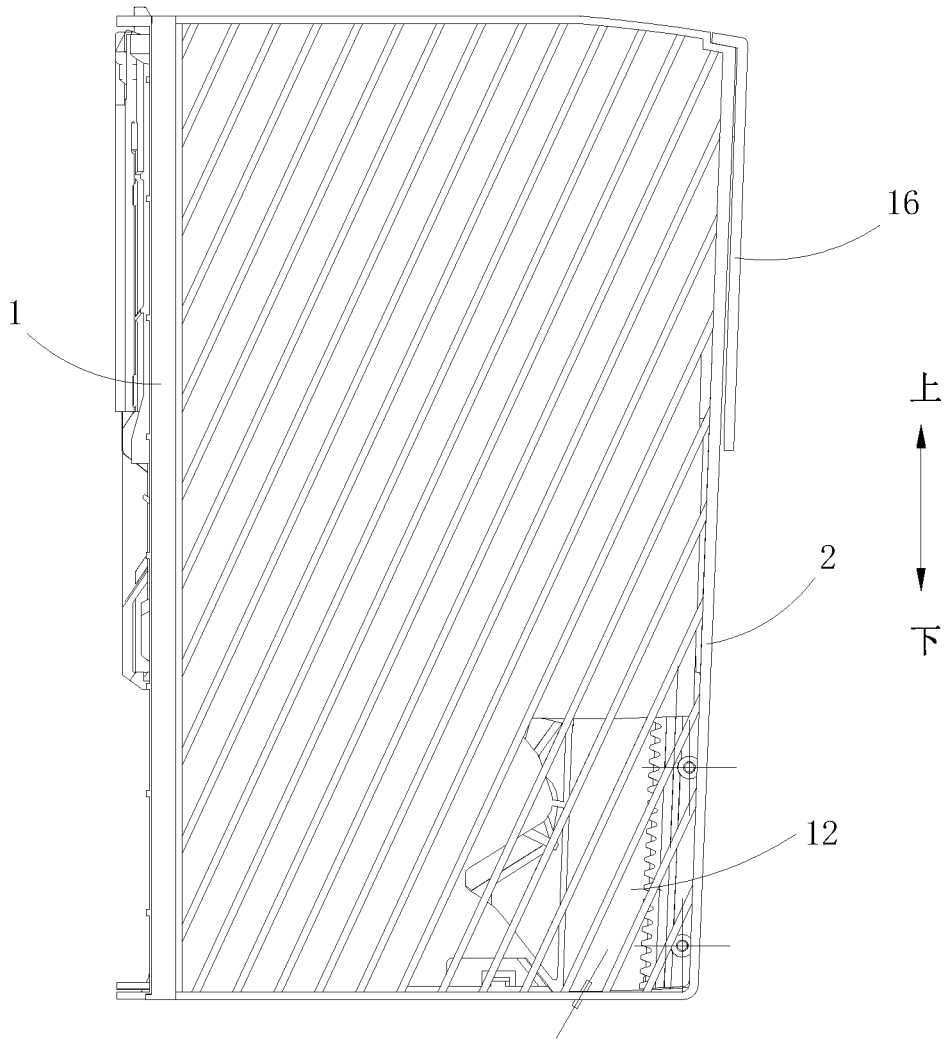
FIG. 3 is a side view of an air conditioner according to an embodiment of the present disclosure.
Figure 4:
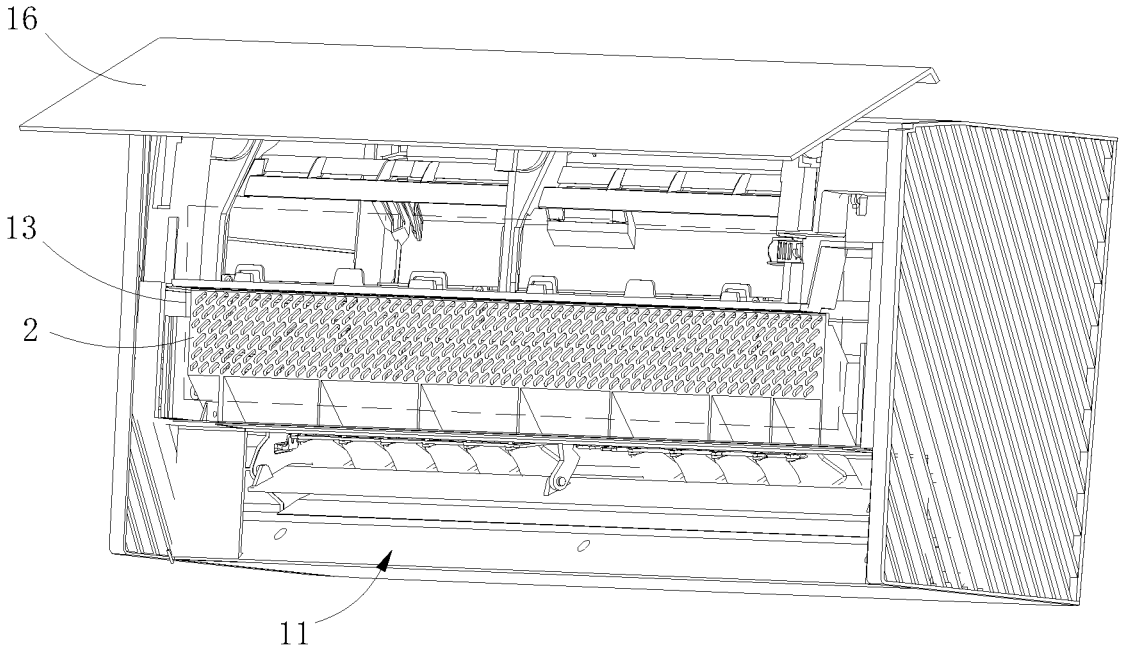
FIG. 4 is a schematic diagram of an air conditioner according to an embodiment of the present disclosure, in a state that an upper panel is opened.
Figure 5:
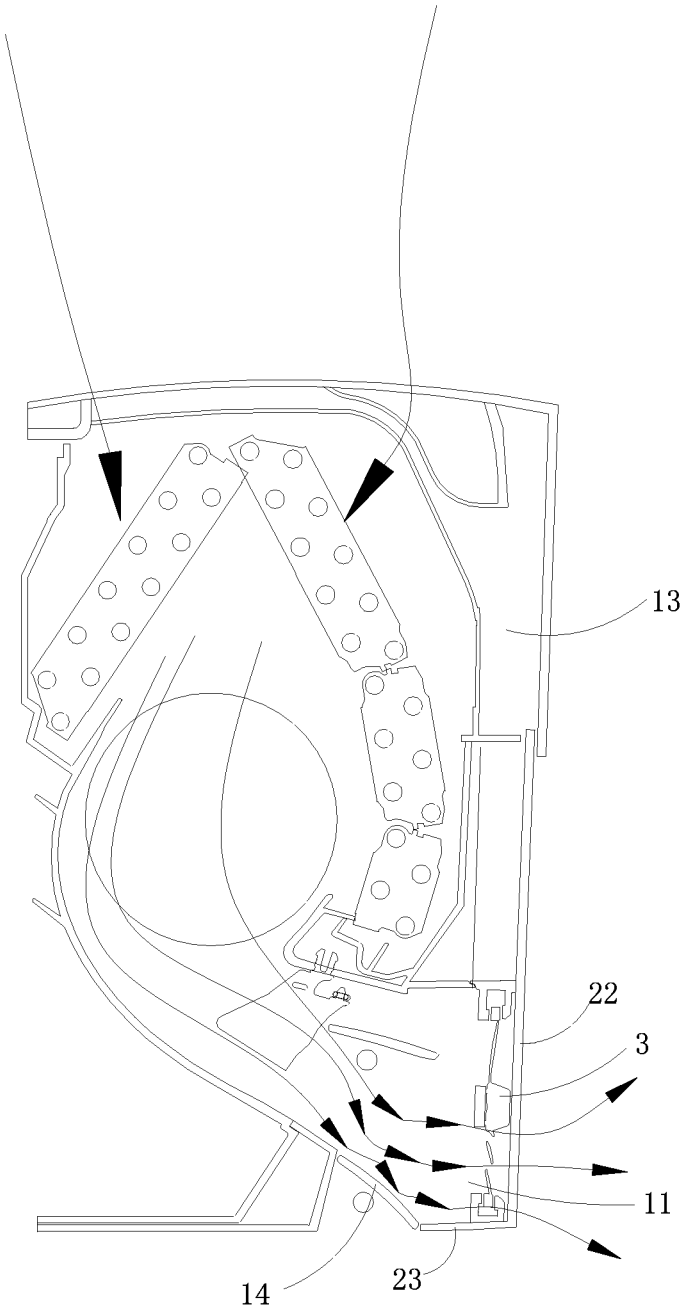
FIG. 5 is a schematic diagram of an air conditioner according to an embodiment of the present disclosure, in a state that a breezeless structure covers a first air outlet.
Figure 6:
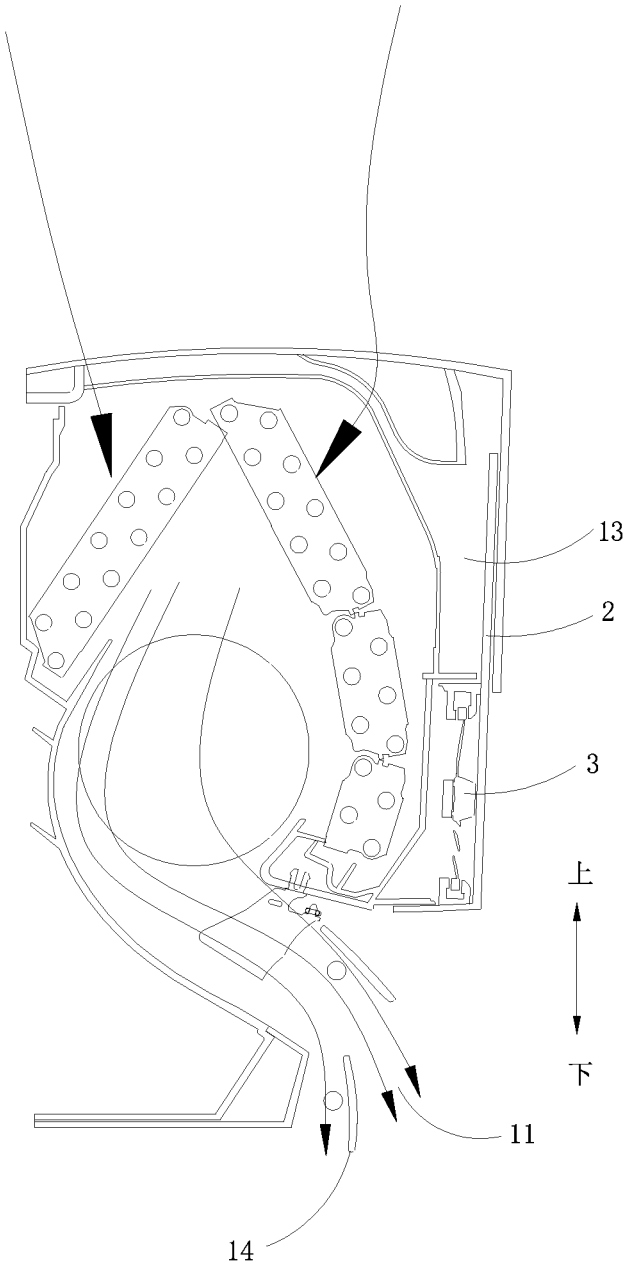
FIG. 6 is a schematic diagram of an air conditioner according to an embodiment of the present disclosure, in a state that a breezeless structure avoids a first air outlet.

In some embodiments of the present disclosure, as shown in FIG. 1 to FIG. 3, two second air outlets 12 are respectively disposed on the left and right sides of the housing 1, the two second air outlets 12 are both in communication with the first air outlet 11. In the state that the movable panel 2 covers the first air outlet 11, after the air blown from the air conditioner 1000 is dispersed by the air dispersing structure 3, a part of the air is diffused or dispersed through the plurality of air dispersing holes 21 on the movable panel 2 and flows to the environment where the air conditioner 1000 is located, and the other part of the air is blown to the environment where the air conditioner 1000 through the two second air outlets 12 on the housing 1. In this way, the air conditioner 1000 can blow air from the side and the front of the housing 1. Therefore, on one hand, an air output amount of the air conditioner 1000 under the breezeless or air-still state can be satisfied, and on the other hand, the air can be blown from the air conditioner 1000 in various angles, thereby further weakening the air-blowing of the air conditioner 1000, so that the air outflow of the air conditioner 1000 is more comfortable.

Further, a louver 121 is rotatably connected inside each second air outlet 12, and a direction of the air blown from the second air outlet 12 can be adjusted by rotating the louver 121. Thus, the direction of the air blown from the second air outlet 12 is more controllable and is prevented from blowing towards the user, thereby further improving the comfortableness of the air conditioner 1000.

In some embodiments of the present disclosure, as shown in FIG. 7 to FIG. 9, the air dispersing structure 3 includes a mounting plate 33 disposed on the movable panel 2, the mounting plate 33 has a ventilation hole 331 disposed thereon, the rotating member 31 is mounted on the mounting plate 33 and is directly opposite to the ventilation hole 331. That is, the mounting plate 33 is provided with the ventilation hole 331 directly opposite to the rotating member 31, so that the air blown from the air conditioner 1000 can flow through the mounting plate 33 via the ventilation hole 331 to prevent the mounting plate 33 from affecting the flowing of the airflow. In addition, the rotating member 31 is mounted on the mounting plate 33, and the mounting plate 33 is connected to the movable panel 2, thereby facilitating the mounting of the rotating member 31 and improving the structural strength of the movable panel 2.

In some embodiments of the present disclosure, the plurality of stationary blades 321 may be disposed in the ventilation hole 331 and spaced apart from each other along a circumferential direction of the ventilation hole 331. Thus, when the airflow flows through the ventilation hole 331, the airflow may be dispersed by the plurality of stationary blades 321, and thus the structure of the breezeless structure 100 is simplified.

In some embodiments of the present disclosure, the mounting plate 33 has a position-limiting protrusion provided thereon. After the movable panel 2 moves to a preset position, the position-limiting protrusion can abut against the housing 1 to prevent the further movement of the movable panel 2, thereby allowing the movement of the movable panel 2 to be more reliable.

In some embodiments of the present disclosure, as shown in FIG. 7 to FIG. 9, the movable panel 2 includes a front side plate 22, and a bottom plate 23 connected to a lower end of the front side plate 22. The plurality of air dispersing holes 21 is defined on the front side plate 22. When the first air outlet 11 is covered by the movable panel 2, the front side plate 22 is directly opposite to the first air outlet 11, the bottom plate 23 is disposed below the first air outlet 11, and the air dispersing structure 3 is disposed on the front side plate 22. That is, the air dispersing structure 3 is disposed on the front side plate 22, and the front side plate 22 is directly opposite to the first air outlet 11, so that the air blown from the air conditioner 1000 can be dispersed through the air dispersing structure 3, and then the dispersed air is dispersed through the plurality of air dispersing holes 21 on the front side plate 22 and flows to the environment where the air conditioner 1000 is located. Therefore, the breezeless or air-still effect of the air-blowing of the air conditioner 1000 can be achieved, and the comfortableness of the air conditioner 1000 can be improved. Meanwhile, by disposing the bottom plate 23, when the bottom plate 23 moves below the first air outlet 11, it can be determined that the movable panel 2 is moved in place.

In some embodiments of the present disclosure, the bottom plate 23 has a plurality of air dispersing holes 21 disposed thereon. That is, after the air blown from the air conditioner 1000 is dispersed by the air dispersing structure 3, a part of the air flows out from the plurality of air dispersing holes 21 on the front side plate 22, and the other part of the air flows out from the plurality of air dispersing holes 21 on the bottom plate 23, so that the air conditioner 1000 can be blown out in multiple directions.

In an embodiment of the present disclosure, another part of the airflow may flow out of the second air outlets 12 on both sides of the housing 1, so that the air conditioner 1000 can discharge air from the sides, front, and bottom of the housing 1 at the same time. On a premise that air-blowing amount from multiple directions can be ensured, the air output from various places is also weakened, so that the air output from the air conditioner 1000 is more comfortable.

In some embodiments of the present disclosure, as shown in FIG. 1 to FIG. 6, a flow guide plate 14 is rotatably connected to the housing 1. In the state that the movable panel 2 covers the first air outlet 11, the flow guide plate 14 can guide a part of the air dispersed by the air dispersing structure 3 to the bottom plate 23, so that the part of the air can be diffused or dispersed through the plurality of air dispersing holes 21 of the bottom plate 23 and flows downward of the air conditioner 1000, thereby preventing the air blown from the first air outlet 11 from directly blowing to the user, and improving comfortableness of the air conditioner 1000.

In some embodiments of the present disclosure, as shown in FIG. 7 to FIG. 9, the breezeless structure 100 further includes a second driving mechanism 5 for driving the movable panel 2 to move. The second driving mechanism 5 includes a motor 51, a gear 52, and a rack 53. The motor 51 is disposed on the housing 1. The gear 52 is connected to an output shaft of the motor 51. A rack 53 is disposed on the air dispersing structure 3, and the rack 53 is adapted to engage with the gear 52. That is, when the movable panel 2 needs to be driven to move, the gear 52 is engaged with the rack 53 on the air dispersing structure 3, and the motor 51 rotates forward or backward to drive the movable panel 2 to move upward or downward, allowing the movement of the movable panel 2 to be more reliable.

In some embodiments of the present disclosure, the second driving mechanisms 5 are disposed on both left and right sides of the breezeless structure 100, and the movable panel 2 is driven to move up and down by the two second driving mechanisms 5 at the same time, allowing the movement of the movable panel 2 to be more reliable.

In some embodiments of the present disclosure, as shown in FIG. 7 to FIG. 9, the breezeless structure 100 further includes a limiting plate 34 disposed on the movable panel 2. During the movement of the movable panel 2, the limiting plate 34 is adapted to contact with the housing 1 to limit a displacement of the movable panel 2. That is, by means of the limiting plate 34 mounted on the movable panel 2, after the movable panel 2 moves to the preset position, the limiting plate 34 can abut against the housing 1 to limit the further movement of the movable panel 2, thereby allowing the movement of the movable panel 2 to be more reliable.

In some embodiments of the present disclosure, the limiting plate 34 has a plurality of through holes 341 disposed thereon and directly opposite to the plurality of rotating members 31, so that the airflow can pass through the limiting plate 34 via the plurality of through holes 341, and the limiting plate 34 is prevented from affecting the flow of the airflow.

The air conditioner 1000 according to an embodiment of the present disclosure includes the housing 1 and the breezeless structure 100. The housing 1 has the first air outlet 11. The breezeless structure 100 is that described in the above embodiments of the present disclosure, the breezeless structure 100 is movably disposed on the housing 1 to at least partially cover the first air outlet 11 or avoid the first air outlet 11, and the breezeless structure 100 is adapted to disperse the air blown from the first air outlet 11.

In the air conditioner 1000 of the embodiment of the present disclosure, the air blown from the air conditioner 1000 is firstly dispersed by the air dispersing structure 3 to achieve the breezeless or air-still effect of the air-blowing of the air conditioner 1000, and thus the comfortableness of the air conditioner 1000 is improved. Meanwhile, each rotating blade 311 is obliquely disposed to allow air to flow on opposite side walls of the rotating blade 311, and/or each stationary blade 321 is obliquely disposed to allow air to flow on opposite side walls of the stationary blade 321. Thus, the opposite side walls of the stationary blade 321 and/or the opposite side walls of the rotating blade 311 can be uniformly heated, thereby avoiding the condensation phenomenon and improving the quality and comfortableness of the air conditioner 1000.

In some embodiments of the present disclosure, as shown in FIG. 1 to FIG. 6, the housing 1 has a receiving cavity 13 disposed therein, and at least a part of the breezeless structure 100 is accommodated in the receiving cavity 13 in a state that the breezeless structure 100 avoids the first air outlet 11. That is, when the breezeless structure 100 covers at least a part of the first air outlet 11, the remaining part of the breezeless structure 100 may be accommodated in the receiving cavity 13 to protect the breezeless structure 100. When the breezeless structure 100 does not need to cover the first air outlet 11, the breezeless structure 100 may be completely accommodated in the receiving cavity 13 to protect the breezeless structure 100.

In some embodiments of the present disclosure, as shown in FIG. 1 to FIG. 6, the front side of the housing 1 has an upper panel 16 provided thereon, and the receiving cavity 13 is defined between the upper panel 16 and the housing 1, thereby simplifying the structure of the receiving cavity 13. Moreover, the portion of the upper panel 16 opposite to the breezeless structure 100 may be made of a transparent material to observe a position of the breezeless structure 100. Thus, the position of the breezeless structure 100 can be more intuitive, so as to facilitate observation and control.

In the specification, descriptions with reference to the terms "an embodiment", "some embodiments", "illustrative embodiments", "an example", "a specific example", "some examples", etc., mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although the embodiments of the present disclosure are illustrated and described above, it is conceivable for those skilled in the art that various changes, modifications, replacements, and variations can be made to these embodiments without departing from the principles and spirit of the present disclosure. The scope of the present disclosure shall be defined by the claims as attached and their equivalents.

What is claimed is:

1. A breezeless structure for an air conditioner,
wherein:
the air conditioner comprises a housing having a first air outlet; and
the breezeless structure comprises:
an air dispersing structure; and
a movable panel configured to be movably disposed on the housing, and
wherein:
the air dispersing structure comprises at least one stationary blade assembly and at least one rotating member that are spaced apart from each other in an air-flowing direction;
the at least one rotating member is configured to be rotatable relative to the at least one stationary blade assembly;
each of the at least one stationary blade assembly comprises a plurality of stationary blades spaced apart from each other in a circumferential direction of the each of the at least one stationary blade assembly;
each of the at least one rotating member comprises a plurality of rotating blades spaced apart from each other in a circumferential direction of the each of the at least one rotating member;
the movable panel comprises a front side plate having a plurality of air dispersing holes;
the air dispersing structure is disposed upstream of the front side plate; and
the movable panel is configured to move the front side plate between a position to avoid the first air outlet and a position to at least partially cover the first air outlet to allow air to first pass through the at least one stationary blade assembly and the at least one rotating member in series in the air-flowing direction and then pass through the plurality of air dispersing holes of the front side plate.

2. The breezeless structure of the air conditioner according to claim 1, wherein:
each of the plurality of rotating blades is obliquely disposed to allow air to flow on opposite side walls of the rotating blade, and each of the plurality of stationary blades is obliquely disposed to allow air to flow on opposite side walls of the stationary blade; and
each of the plurality of rotating blades and each of the plurality of stationary blades are obliquely disposed along a same oblique direction.

3. The breezeless structure of the air conditioner according to claim 1, further comprising a first driving member, wherein the first driving member is configured to drive the at least one rotating member to rotate.

4. The breezeless structure of the air conditioner according to claim 3, wherein:
the at least one rotating member comprises a plurality of rotating members; and
the breezeless structure further comprises a transmission gear disposed between every two adjacent rotating members of the plurality of rotating members and engaged with the every two adjacent rotating members to allow the plurality of rotating members to rotate synchronously.

5. The breezeless structure of the air conditioner according to claim 4, wherein:

the at least one stationary blade assembly comprises a plurality of stationary blade assemblies; and the plurality of stationary blade assemblies are provided in one-to-one correspondence with the plurality of rotating members.

6. The breezeless structure of the air conditioner according to claim 1, wherein:

the air dispersing structure further comprises a mounting plate disposed on the movable panel;

the mounting plate has a ventilation hole;

the at least one rotating member is rotatably connected to the mounting plate and directly opposite to the ventilation hole; and the stationary blade assembly is disposed in the ventilation hole.

7. The breezeless structure of the air conditioner according to claim 1, wherein:

the movable panel comprises the front side plate and a bottom plate, wherein the bottom plate is connected to a lower end of the front side plate; and when the first air outlet is covered by the movable panel, the front side plate is directly opposite to the first air outlet, the bottom plate is disposed below the first air outlet, and the air dispersing structure is disposed on the front side plate.

8. The breezeless structure of the air conditioner according to claim 1, further comprising a limiting plate disposed on the movable panel, wherein the limiting plate is configured to, during a movement of the movable panel, be in contact with the housing to limit a displacement of the movable panel.

9. The breezeless structure according to claim 1, wherein each of the plurality of rotating blades is obliquely disposed to allow air to flow on opposite side walls of the rotating blade, and/or each of the plurality of stationary blades is obliquely disposed to allow air to flow on opposite side walls of the stationary blade.

10. An air conditioner comprising:

a housing having a first air outlet; and a breezeless structure comprising:

an air dispersing structure; and a movable panel configured to be movably disposed on the housing, wherein:

the air dispersing structure comprises at least one stationary blade assembly and at least one rotating member that are spaced apart from each other in an air-flowing direction;

the at least one rotating member is configured to be rotatable relative to the at least one stationary blade assembly;

each of the at least one stationary blade assembly comprises a plurality of stationary blades spaced apart from each other in a circumferential direction of the each of the at least one stationary blade assembly;

each of the at least one rotating member comprises a plurality of rotating blades spaced apart from each other in a circumferential direction of the each of the at least one rotating member;

the movable panel comprises a front side plate having a plurality of air dispersing holes;

the air dispersing structure is disposed upstream of the front side plate; and the movable panel is configured to move the front side plate between a position to avoid the first air outlet and a position to at least partially cover the first air outlet to first pass through the at least one stationary blade assembly and the at least one rotating member in series in the air-flowing direction and then pass through the plurality of air dispersing holes of the front side plate.

11. The air conditioner according to claim 10, wherein:

each of the plurality of rotating blades is obliquely disposed to allow air to flow on opposite side walls of the rotating blade, and each of the plurality of stationary blades is obliquely disposed to allow air to flow on opposite side walls of the stationary blade; and each of the plurality of rotating blades and each of the plurality of stationary blades are obliquely disposed along a same oblique direction.

12. The air conditioner according to claim 10, wherein the breezeless structure further comprises a first driving member, and the first driving member is configured to drive the at least one rotating member to rotate.

13. The air conditioner according to claim 12, wherein:

the at least one rotating member comprises a plurality of rotating members; and the breezeless structure further comprises a transmission gear disposed between every two adjacent rotating members of the plurality of rotating members and engaged with the every two adjacent rotating members to allow the plurality of rotating members to rotate synchronously.

14. The air conditioner according to claim 13, wherein:

the at least one stationary blade assembly comprises a plurality of stationary blade assemblies; and the plurality of stationary blade assemblies are provided in one-to-one correspondence with the plurality of rotating members.

15. The air conditioner according to claim 10, wherein:

the air dispersing structure further comprises a mounting plate disposed on the movable panel;

the mounting plate has a ventilation hole;

the at least one rotating member is rotatably connected to the mounting plate and directly opposite to the ventilation hole; and the stationary blade assembly is disposed in the ventilation hole.

16. The air conditioner according to claim 10, wherein:

the movable panel comprises the front side plate and a bottom plate, wherein the bottom plate is connected to a lower end of the front side plate; and when the first air outlet is covered by the movable panel, the front side plate is directly opposite to the first air outlet, the bottom plate is disposed below the first air outlet, and the air dispersing structure is disposed on the front side plate.

17. The air conditioner according to claim 10, wherein:

the breezeless structure further comprises a limiting plate disposed on the movable panel, and the limiting plate is configured to, during a movement of the movable panel, be in contact with the housing to limit a displacement of the movable panel.

18. The air conditioner according to claim 10, wherein each of the plurality of rotating blades is obliquely disposed to allow air to flow on opposite side walls of the rotating blade, and/or each of the plurality of stationary blades is obliquely disposed to allow air to flow on opposite side walls of the stationary blade.

* * * * *